United States Patent [19]

Ackermann et al.

[11] Patent Number: 4,814,210

[45] Date of Patent: Mar. 21, 1989

[54] PROCESS AND MEANS FOR HOT-DIP GALVANIZING FINNED TUBES

[76] Inventors: Werner Ackermann, Thurnstrasse 35, 5900 Siegen 1; Klaus Schirmuly, Heuslingstrasse 510a, 5905 Freudenberg-Bottenberg, both of Fed. Rep. of Germany

[21] Appl. No.: 145,902

[22] Filed: Jan. 20, 1988

Related U.S. Application Data

[63] Continuation-in-part of Ser. No. 670,334, Nov. 9, 1984, abandoned.

[51] Int. Cl.[4] ..... C23C 2/34

[52] U.S. Cl. ..... 427/433; 118/404

[58] Field of Search ..... 427/433; 118/404, 405; 193/35 C, 35 R

[56] References Cited

U.S. PATENT DOCUMENTS

| | | | |
|---|---|---|---|
| 2,818,954 | 1/1958 | Vice | 193/35 C |
| 3,122,114 | 2/1964 | Kringel | 427/321 |
| 3,131,799 | 5/1964 | Ribeton | 193/35 C |
| 3,226,817 | 1/1966 | Sinberg | 427/310 |
| 3,722,463 | 3/1973 | Kudo | 118/DIG. 11 |
| 4,250,207 | 2/1981 | Higgshi | 427/321 |

FOREIGN PATENT DOCUMENTS

| | | | |
|---|---|---|---|
| 546892 | 10/1957 | Canada | 427/310 |

*Primary Examiner*—Sam Silverberg
*Attorney, Agent, or Firm*—Mueller and Smith

[57] ABSTRACT

In a process for hot-galvanizing finned tube, with the finned tubes being of varying geometry, coating with galvanizing media by flooding with such media in a galvanizing pan, the finned tubes automatically pass successively by a transport means consisting of horizontally and vertically mounted supporting, guiding, and driving rollers, and synchronous carrying chain through treatment stages including degreasing, rinsing, pickling, heating, galvanizing, cooling, drying, chromating, and blasting stages for mechanical tumbling/-stripping/brushing means, so as to ensure, with additional parameters, the broadest possible range of application in consideration of the economy and requirements relating to environmental protection.

14 Claims, 3 Drawing Sheets

PROCESS AND MEANS FOR HOT-DIP GALVANIZING FINNED TUBES

CROSS-REFERENCE TO RELATED APPLICATION

This application is a continuation-in-part of U.S. application Ser. No. 670,334, filed Nov. 9, 1984, now abandoned.

BACKGROUND OF THE INVENTION

U.S. Pat. No. 3,722,463 issued to Kudo, et al., a further development of U.S. Pat. No. 3,122,114, issued to T.H. Kringel, et al., clearly demonstrates the economies associated with hot-galvanizing tubing in a continuous manner. In this regard, U.S. Pat. No. 3,722,463 relates to a process and means exclusively matched as to design and, hence, exclusively suited for hot-galvanizing of smooth tubes. One individual smooth tubes are joined to form a continuous tube, pre-treatment of the joined-together smooth tubes comprises a fluxing agent treatment (zinc-ammonium-chloride) and subsequent drying at about 200° C. This mode of galvanizing entails, through sublimation of the fluxing agent, considerable exhaust air volumes laden with large quantities of harmful substances. Requirements having to do with environmental control can be met here only by way of an exhaust air trapping means and a purifying system connected therebehind, with this substantially reducing the economy of the system as a whole. Moreover, this known process and means for hot-galvanizing tubes is suited exclusively to smooth tubes.

The invention underlying the subject application, by contrast, relates to a process and means for galvanizing finned tubes, without the classic fluxing agent treatment and its negative environmental consequences, and with careful consideration of the specific requirements for hot-galvanizing and manipulating finned tubes.

The finned tube consists substantially of an oval base tube (or of other cross-section), onto which there is continuously, diagonally wound a sheet of metal fin according to the winding method employed. The finned tube is in no way bound to the base tube and often is of a substantially different material or thickness, and hence the finned tube willl often exhibit divergent coefficients of thermal expansion. The pitch of a typical finned tube amounts to approximately 3 mm; so that the surface area of a finned tube may be 40 times that of a smooth tube of comparable size and shape.

Prior art in conjunction with hot-galvanizing of finned tubes is the immersion into a zinc melt with preceding degreasing, rinsing, pickling, rinsing, and fluxing. These preliminary treatments are individual, separate operations, with the finned tubes being respectively dipped into individual baths containing the corresponding degreasing, rinsing, pickling, or like medium, e.g. by means of a crane. Cooling takes place in a water bath so that an immediate further treatment of the finned tube after galvanizing, is in qualified manner not possible.

SUMMARY OF THE INVENTION

It is the object of the present invention to provide a process as well as a means for carrying out the process of continuous galvanization of finned tubes without the negative environmental consequences, but with consideration of the delicate and troublesome nature of finned tube geometry.

According to the invention, the object is accomplished in a manner such that the finned tubes are slowly pre-heated in an inert atmosphere in order to accommodate the divergent thermal characteristics of the fin and base tube, while at the same time preventing oxidation of such tubes. The inert atmosphere present in the preheating and galvanizing stages also eliminates the need for flux treating the tubes and all of the negative environmental consequences associated therewith. The finned tube is transported through the process by means of guide, drive, and support rollers, and a drive chain, wherein the finned tube merely rests upon the particular communicative means. Treatment stages include degreasing, rinsing, pickling, heating, galvanizing, cooling, drying, chromating, and blasting/mechanical stripping/tumbling. The galvanizing stage is accomplished by flooding the finned tube with galvanizing metal in a galvanizing furnace. Both drip and blow-off mechanisms are used to recollect unbound galvanizing metal in order to increase the economy of the process.

The advantages provided for by the process and means according to the invention reside, in particular, in that it is made possible to be able to continuously or discontinuously pretreat, galvanize, and post-treat finned tubes in self-contained treatment stages connected at short intervals in line one behind the other and, hence, optimize economical control of the zinc layer thickness, and consideration of factors having to do with emission.

Other objects of the invention will, in part, be obvious and will, in part, appear hereinafter.

The invention, accordingly, comprises the process and means possessing the construction, combination of elements, and arrangement of parts which are exemplified in the following description.

For a fuller understanding of the nature and objects of the invention, reference should be had to the following detailed description taken in connection with the accompanying drawings.

DETAILED DESCRIPTION OF THE INVENTION

Figure 1:
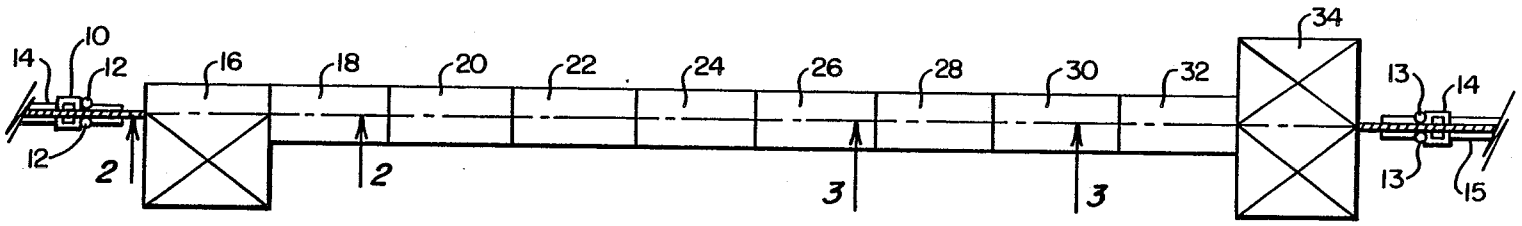
FIG. 1 is an overall top-view of the galvanizing system.

FIG. 1 is a graphical depiction of the in-line stages for hot-galvanizing finned tubes in accordance with the process disclosed in the present invention. The stages comprise feed zone 16, degreasing zone 18 with blast-off means, rinsing zone 20 with blast-off means, picking zone 22 with blast-off means, rinsing zone 24 with blast-off means, pre-heating furnace 26, galvanizing furnace 28 with blast-off/tumbling/stripping means, cooling and drying zone 30, chromating zone 32, and withdrawal zone 34. The finned tubes are fed into and withdrawn from the process over stands 14 and 15 housing synchronous drive rollers 10 and 11, and plastic guide rollers 12 and 13 to prevent damaging the fins. All of the various zones 16 through 34 of the system are carried out in metal chambers, the sole exception being the galvanizing furnace stage 28 in which the chamber consists of a combination of a refractory lining and ceramic coated metal parts. Other materials of construction may be appropriate depending upon suitability for the conditions of operation, e.g. elevated temperature, inert atmosphere, chromating metals, or the like.

Figure 2:
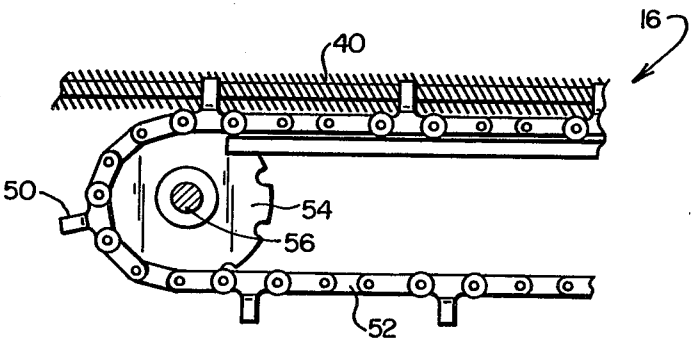
FIG. 2 is a side view of the chain drive transport device taken along line 2—2 of FIG. 1.

Referring to FIG. 2, the drive chain used to guide and transport the finned tube between stages 16 and 26 is shown at an enhanced level of detail. The speed of the drive chain is infinitely variable and synchronized with the drive rollers. Chain 52 has attached upstanding side arms 50 for providing lateral support of the finned tube 40. Chain 52 is driven by cog 54 and drive shaft 56. Note that the drive chain is insufficient for use in galvanizing furnace 28 as the molten galvanizing media may tend to clog and freeze the chain.

In pre-heating furnace 26, the finned tubes are preheated, preferably indirectly, and gradually. A heating rate of about 5° C.–10° C./sec. is desirable. Heating rates substantially about about 10° per second have been determined to be detrimental to the finned tubes configuration, as it must be remembered that the fins are not attached to the base metal tube, but merely are wound therearound. If the heating rate is too high, the strain caused by the different thermal expansion characteristics between the base tube and the wound fin could result in an unequal separation of the fins from the base tube.

At a heating rate below about 5°/sec., the dwell time of the finned tubes in the pre-heating furnace 26 can become too long. If the residence time is too great, hydrogen diffusion can result in the formation of pickle blisters or pickle fissures, and eventually lead to an embrittlement of the fins and/or tubes. Such embrittlement will occur specifically at lattice imperfections or other imperfections in the material of the fins of the tubes. Thus, the preferred heating rate indicated above.

Figure 3:
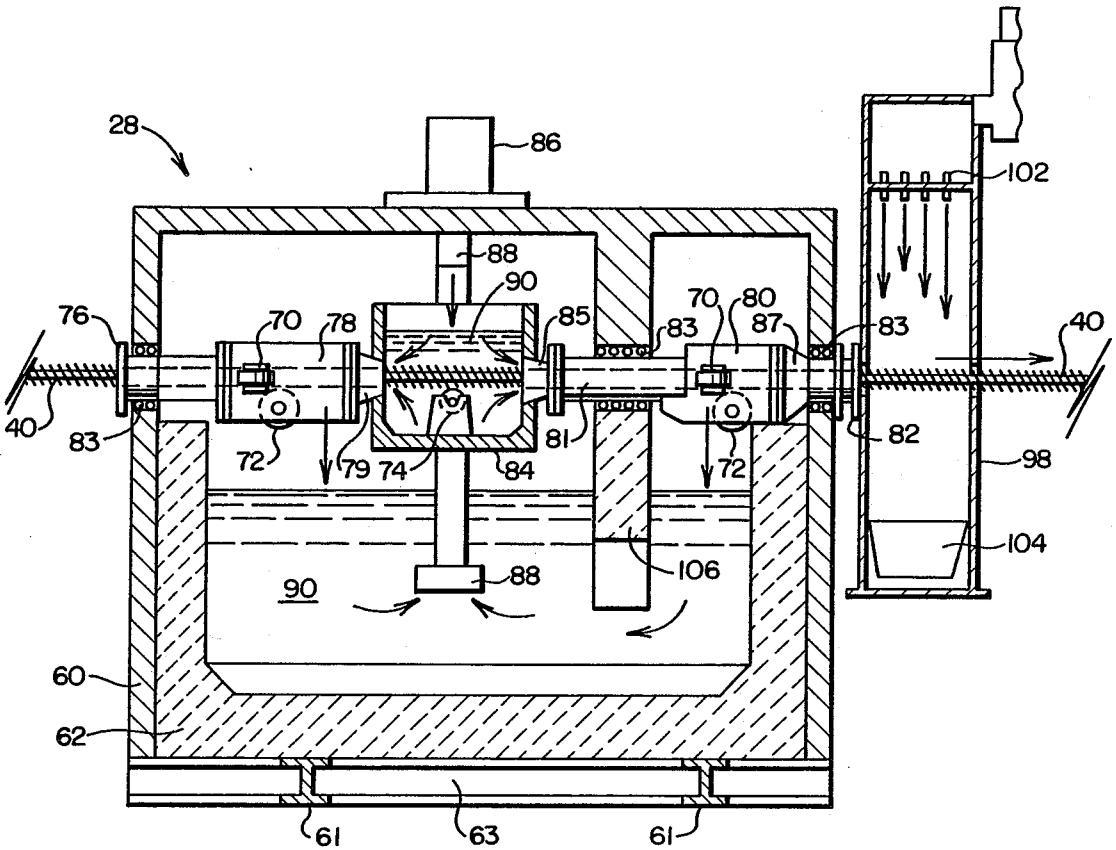
FIG. 3 is a cross-sectional elevational side view of the galvanizing furnace taken along line 3—3 of FIG. 1.

Referring now to FIG. 3, the galvanizing furnace 28 generally is shown at an enhanced level of detail. Galvanizing furnace 28 is housed on top and sides by metal as are the other zones in the process, however, this zone is lined with refractory tile as represented at 62 to insulate the steel housing from the molten galvanizing media represented at 90. Additional insulation is provided by air gap 63 created by support beams 61. Additionally, the zone is divided into two areas by partition 106 to the right of which lies the outlet flood trough and charging sections and to the left of which lies the inlet flood trough and galvanizing sections. Finned tube 40 enters galvanizing furnace 28 from left-to-right via flanged passageway 76 into inlet flood trough 78. Passageway 76 is held gas tight to furnace casement 60 by means of surrounding gas-tight packing 83. Unlike the guide rollers of the feed drive system and withdrawal drive system, guide roller 70 in galvanizing furnace 28 is constructed of metal, rather than plastic as are rollers 12 and 13 (FIG. 1) because of the high temperature of the furnace. Because the carrying chain cannot be used in the galvanizing furnace, synchronized drive rollers 72 and 73 propel finned tube 40 through furnace 28. Before finned tube 40 enters flooding trough 84, recall that finned tube 40 has been preheated by forced air heat sources (not shown) disposed in zone 26. Each of the pre-heating heat sources are capable of being individually controlled. Hence, heating of finned tube 40 advantageously takes place continuously from room temperature to the galvanizing temperature in the zinc bath of approximately 450° to 560° C. at a rate determined by the system operators.

Finned tube 40 exits the guide and drive stage 78 through passageway 79 into galvanizing pan or ladle 84. Finned tube 40 is supported by support roller 74 in ladle 84 and flooded with galvanizing media by pump 84 which lifts galvanizing media in column 88 from melting range 90 to galvanizing ladle 84. The galvanizing media utilized preferably is zinc or zine alloy. Finned tube 40 then exits galvanizing ladle 184 through passageways 85 and 81 passing from the galvanizing section of the furnace to the charging section of the furnace. Outlet flood trough 80 is analogous to inlet flood trough 78 with the exception that a greater portion of excess galvanizing media will drip off into pool 90 below from the outlet flood trough. To this end, an outlet port in the bottom of troughs 78 and 80 permits excess galvanizing metal to flow from ladle 84 thereinto, and thence into bath 90. Thus, some galvanizing does occur in troughs 78 and 80. The size of passageways 79, 85, and 81, and the ports in troughs 78 and 80 help establish the level of galvanizing media in ladle 84 in addition to pump 86. Finned tube 40 then exits galvanizing furnace 28 via gas-tight passageway 87, leaving the protective gas headspace which prevented oxidation of the finned tube in the preheating and galvanizing zones of the system at 26 and 28 (FIG. 1). Nitrogen with a hydrogen portion of approximately 10% preferably is utilized as the inert gas.

Next, finned tube 40 enters the blast-off chamber represented at 98 via flanged passageway 82. In conjunction with mechanical stripping/tumbling/brushing means, excess galvanizing media is blasted-off by nozzle array 102. The occurrence of ridge formations between the finned tube windings and the formation of a drip-off edge, thus, is effectively avoided. Additionally, blast-off zone 98 permits recovery and re-use of the excess galvanizing media which falls into drip pan 104 which is removable trough a front-access panel (not shown).

Figure 4:
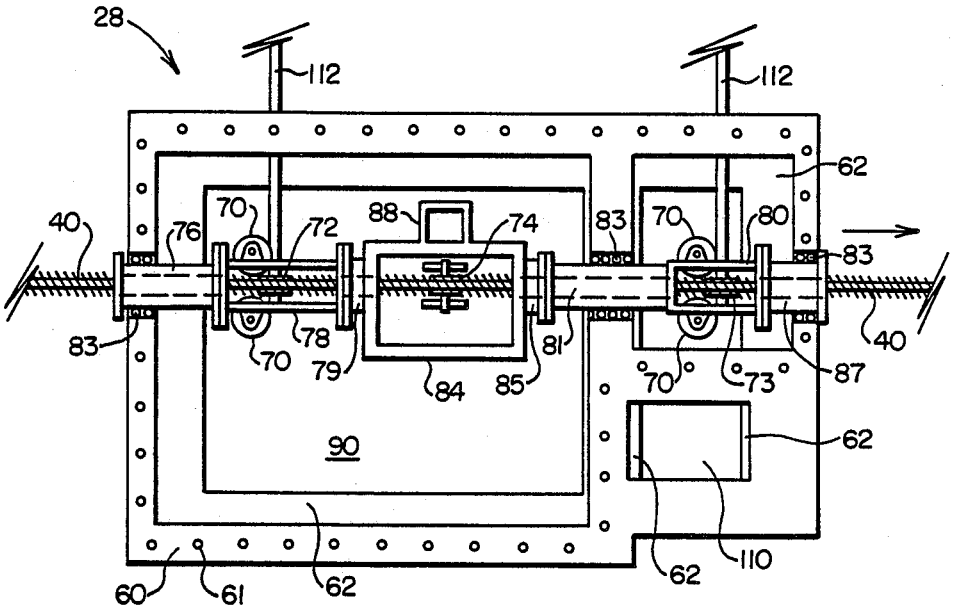
FIG. 4 is a top view of the galvanizing furnace depicted in FIG. 3 with the furnace cover removed.

FIG. 4 provides additional detail information about galvanizing furnace 28. Screw holes 61 in galvanizing furnace metal housing 60 are used to fasten the furnace cover (not shown) gas tight to the furnace encasement by bolts (also not shown). Drive rollers 72 used to convey the finned tube through the galvanizing furnace as shown in FIG. 3, are reproduced in FIG. 4 with the attached drive shafts as represented at 112. Galvanizing media in charging section 110 of galvanizing furnace 28 is melted with a high voltage electrical arc.

The galvanized finned tube withdrawn from the process also should be cooled at a determined rate much in the manner as the heating schedule described above. Again, this cooling preferably is continuous and at the rate of between about 5° C.–10° C. per second. Cooling rates above 10° C. per second can be practiced only when the temperature of the galvanized finned tube is below about 100° C. Again, the heating and cooling rates provide tempering time for equalization of residual thermal stresses resulting from the finned tube being heated to elevated temperature or cooled from elevated temperature. After the galvanized finned tubes are stabilized, the fins are "welded" to the base tube by means of the galvanizing zinc.

Next, due to the high surface area of the finned tubes, care must be exercised in order to avoid excessive zinc losses from galvanizing furnace 28. At a surface area of about 400 square meters/ton of finned tubes, zinc losses ranging from about 85 Kg per ton to 210 Kg per ton of finned tubes must be taken into account. Such zinc losses of course vary depending upon the thickness of the zinc galvanizing layer. The specific geometry of the finned tubes also has and effect of a conveyor spiral which obviously entails further zinc losses. Depending upon the galvanizing rate, these losses have been determined to range from between about 10 an 30 Kg per ton of finned tubes. In view of the high cost of the material and specifically the high energy costs for maintaining zinc bath 90, zinc losses should be minimized. By providing for the draining of excess zinc from ladle 84 back into bath 90, zinc losses are reduced. The drained zinc remains under the protective gas atmosphere and drains immediately into the zinc melt or bath 90. Thus, oxidizing losses of the zinc should be virtually eliminated. The loss rate of about 10–30 Kg/ton are reduced by about 50 percent by such method of operation. The significance of charging zone 110 being separated from zinc bath 90 by wall 106 permits a continuous compensation of zinc losses by adding new zinc to the melt without interfering with the inert gas atmosphere which has been established in the head space in furnace 28. Loss of the protective gas atmosphere also is avoided. Finally, in order to guarantee satisfactory galvanization of the finned tubes, the zinc pump should provide a volumetric capacity of preferably about 80–100 tons/hr. Such rate corresponds to about 200 changes of the zinc melt per hour in galvanizing ladle 84.

Finally, it will be appreciated that the tapering of passageway 87 and the size of passageway 76 are such that the cross-sectional area of such passageways is only slightly larger than the cross-sectional area of finned tube 40. Such constrictions or narrow apertures also aid in preventing loss of the inert or non-oxidizing atmosphere established in furnace 28.

Since certain changes may be made in the above system and method without departing from the scope of the invention herein involved, it is intended that all matter contained in the above description or shown in the accompanying drawings shall be interpreted as illustrative and not in a limiting sense.

We claim:

1. A process for hot-galvanizing finned tubes of varying geometry which comprises:

(a) passing said finned tube into a pre-heating zone with drive chain means atop which rests said finned tube, said drive chain means having upstanding side arms fixed for laterally supporting said finned tube;

(b) heating said finned tube in said preheating zone to about galvanizing temperature under a non-oxidizing atmosphere;

(c) passing said heated finned tube into a galvanizing furnace having a galvanizing ladle flooded with galvanizing metal and therein immersing said finned tube; the headspace in said furnace containing a non-oxidizing atmosphere wherein said galvenizing furnace contains rollers atop which rests said finned tube and side guide rollers for laterally supporting said finned tube; and (d) withdrawing said galvanized finned tube from said galvanizing furnace.

2. The process of claim 1 wherein said finned tube is degreased, pickled, and rinsed prior to step (a).

3. The process of claim 2 wherein said galvanized finned tube is chromated.

4. The process of claim 3 in which said finned tube is continuously processed.

5. The process of claim 1 wherein said withdrawn galvanized finned tube is subjected to treatment for removal of excess adherent galvanizing metal.

6. The process of claim 5 wherein said treatment comprises blasts of air.

7. The process of claim 1 wherein said finned tubes are heated in said pre-heating zone by means of indirectly gas-heaters.

8. The process of claim 1 wherein said non-oxidizing atmosphere comprises nitrogen gas.

9. The process of claim 1 wherein application of a fluxing agent to said finned tube fed to the process is omitted.

10. The process of claim 1 wherein said galvanizing metal comprises zinc or a zinc alloy.

11. The process of claim 5 wherein said removal means is selected from the group consisting of blast-off nozzle means, mechanical stripping means, tumbling means, and combinations thereof.

12. A galvanizing furnace for hot-galvanizing finned tubes of varying geometry which comprises:

(a) a pre-heating zone fitted with drive chain means atop which can rest said finned tube, said drive chain means having upstanding side arms for laterally supporting said finned tube, said pre-heating zone containing heating means to heat said finned tube to galvanizing temperature and adapted to contain a non-oxidizing atmosphere;

(b) a galvanizing furnace in communication with said pre-heating zone and adapted to also contain a non-oxidizing atmosphere, said galvanizing furnace comprising a melting range for receiving molten zinc or an alloy of molten zinc, a galvanizing ladle disposed overhead of said melting range, and zinc-charging range for supplying said molten zinc or alloy therof to said melting range; a zinc pump for pumping said molten zinc or alloy thereof from said melting range into said overhead galvanizing ladle, and an inlet and an outlet region connecting with said galvanizing ladle and being provided with overflow means wherein excess zinc flowing from said galvanizing ladle into said inlet and outlet regions falls back into said melting range, each said region bearing a pair of lateral guide rollers and a drive roller atop which rests said finned tube, whereby said finned tube passes from said inlet region flooded with said molten zinc or alloy thereof through said galvanizing ladle also flooded with said molten zinc or alloy thereof, and into said outlet region also flooded with said molten zinc or alloy thereof, and then out of said galvanizing furnace.

13. The galvanizing furnace of claim 12 wherein said heating means in said pre-heating zone comprises heated air.

14. The galvanizing furnace of claim 12 wherein said zinc or alloy thereof melted in said melting range with a high voltage electrical arc.

* * * * *